US005104054A

United States Patent [19]

Latham

[11] Patent Number: 5,104,054

[45] Date of Patent: Apr. 14, 1992

[54] PORTABLE PAPER PRODUCT DISPENSER

[76] Inventor: Peter Latham, 320 Pioneer Rd., Rye, N.H. 03780

[21] Appl. No.: 464,923

[22] Filed: Jan. 16, 1990

[51] Int. Cl.[5] ..... B65H 19/00

[52] U.S. Cl. ..... 242/55.53; 206/408; 206/470; 220/4.24

[58] Field of Search ..... 242/55.2, 55.53, 130.2, 242/132, 137, 138, 146; 206/408, 409, 467, 470; 220/4.22, 4.24

[56] References Cited

U.S. PATENT DOCUMENTS

| | | | |
|---|---|---|---|
| 1,001,402 | 8/1911 | Hindle | 242/55.53 |
| 1,099,766 | 6/1914 | Prince | 242/137 |
| 2,064,087 | 12/1936 | Smith | 248/205.1 |
| 2,872,263 | 2/1959 | Andersson | 312/39 |
| 2,879,012 | 3/1959 | Sarro | 242/55.2 |
| 3,259,287 | 7/1966 | Spiker | 225/34 |
| 3,417,935 | 12/1968 | Douglas et al. | 242/55.2 |
| 3,527,342 | 9/1970 | Manzo | 206/409 |
| 3,667,597 | 6/1972 | Hollister | 242/55.53 X |
| 3,685,777 | 8/1972 | Dema | 248/205.1 |
| 3,698,548 | 10/1972 | Stenzel et al. | 242/55.53 |
| 3,721,395 | 3/1973 | Snipes | 242/55.53 |
| 4,032,004 | 6/1977 | Coates | 206/39.6 |
| 4,410,221 | 10/1963 | Vallis et al. | 242/55.3 X |
| 4,431,139 | 2/1984 | Barnsbee et al. | 242/55.53 |
| 4,537,366 | 8/1985 | Swenson et al. | 242/137 |
| 4,570,888 | 2/1986 | Evans | 248/205.1 |
| 4,614,312 | 9/1986 | Del Pino | 242/55.2 |
| 4,676,446 | 6/1987 | Ciocarelli et al. | 206/408 X |
| 4,690,345 | 9/1987 | Cotey | 242/55.53 |
| 4,691,396 | 9/1987 | Hoffman | 248/205.1 X |
| 4,706,904 | 11/1987 | Raymond | 206/409 |
| 4,739,883 | 4/1988 | Mohs | 206/470 |

FOREIGN PATENT DOCUMENTS

| | | |
|---|---|---|
| 427447 | 8/1911 | France . |
| 656290 | 8/1951 | United Kingdom . |

*Primary Examiner*—Lenard A. Footland
*Assistant Examiner*—William G. Battista, Jr.
*Attorney, Agent, or Firm*—Davis, Bujold & Streck

[57] ABSTRACT

A dispensing device for dispensing paper product supported on a roll comprising a pair of open-sided members which are hinged together along one longitudinal edge thereof. Each of the open-sided members comprises a curved base portion and has a pair of opposed end walls, and one or both of the open-sided members has an elongate slot for dispensing the paper product. Each open-sided member is provided with a flap area each of which carries one component of a mating interlocking mechanism so that when the open-sided members are pivoted about the hinge, the mechanisms releasably engage one another and the open-sided members substantially enclose a roll of paper product therein. An enlarged end portion is provided in each flap area, remote from the open-sided member, along with a pair of support holes.

15 Claims, 4 Drawing Sheets

FIG. 2A
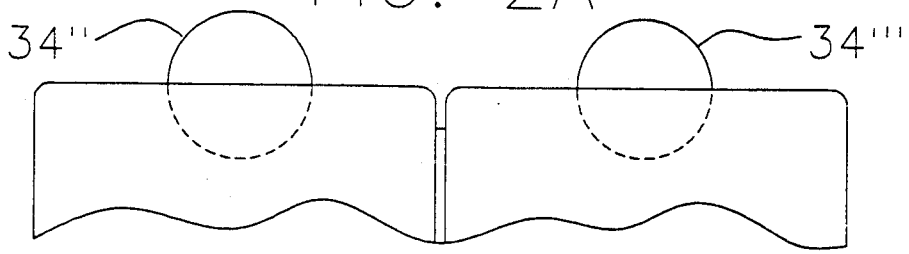
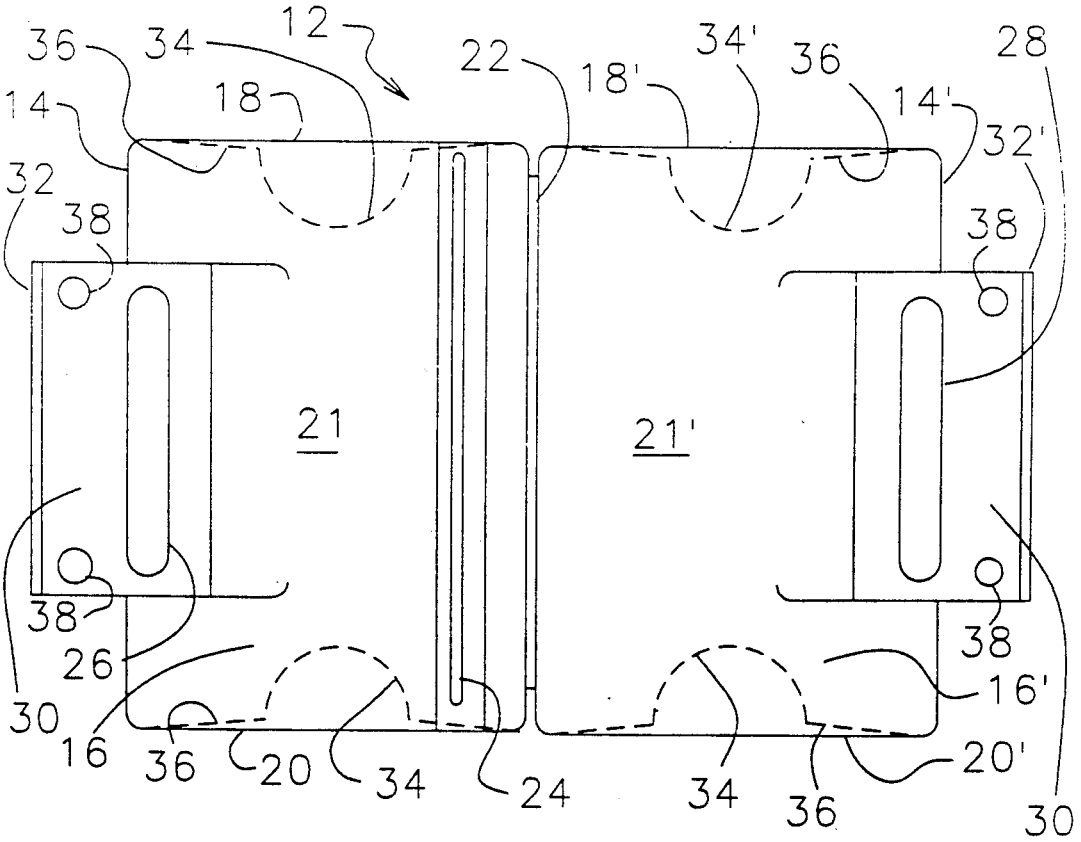
FIG. 2

PORTABLE PAPER PRODUCT DISPENSER

The present invention relates to a portable container which allows easy and convenient dispensing of a roll of paper product contained therein, in sheet form, while protecting the paper product from moisture and/or damage.

BACKGROUND OF THE INVENTION

There are a variety of known prior art devices for dispensing paper products from a container, for instance, see U.S. Pat. Nos. 1,001,402, 2,064,087, 2,872,263, 2,879,012, 3,259,287, 3,417,935, 3,685,777, 3,721,395, 4,032,004, 4,410,221, 4,570,888, 4,614,312, 4,690,345, 4,691,396 and Great Britain Patent Specification 656,290. All of these known prior art devices are intended to be secured to a surface to allow the paper product to be appropriately dispensed. However, none of these references teach a truly portable, lightweight dispensing device which is easily hung or wedged between two adjacent surfaces to facilitate one-handed dispensing of the paper product contained therein.

Wherefore, it is a primary object of the invention to provide a lightweight, inexpensive and durable dispensing device, having a slot for dispensing purposes, which protects the roll of paper product contained therein.

Another object of the invention is to provide the dispensing device with a flap region having an enlarged area on a distal end thereof which allows the device to be wedged between two closely mating members so that the device is releasably secured thereto.

A still further object of the invention is to provide a dispensing device arrangement which facilitates rotation of the paper product contained therein to improve dispensing of the paper product.

SUMMARY OF THE INVENTION

According to the invention, there is provided a portable dispensing device, for dispensing paper products supported on a roll, comprising a container for substantially encasing a paper product supported on a roll, said container having a pair of opposed end walls and a longitudinal slot extending from adjacent one end wall to adjacent the other end wall for dispensing the paper product from the roll as desired.

According to the preferred embodiment, there is provided a portable dispensing device, for dispensing paper products supported on a roll, comprising first and second open-sided members being connected to one another along a longitudinal edge thereof by hinge means whereby said first and second open sided members pivot about said hinge means to encase a paper product supported on a roll, at least one of said open-sided members having a longitudinal slot for dispensing the paper product from the roll as desired; said first and second open-sided members each having flap means connected thereto along a longitudinal edge opposite said hinge means, each said flap means having an elongate enlarged portion, remote from said open-sided member, which is at least partial deformable when said flap means is positioned between two closely spaced but separable members.

BRIEF DESCRIPTION OF THE DRAWINGS

The above and other objects of the invention will be better understood with reference to the accompanying drawings, which describe a preferred embodiment of the invention, by way of example, in which:

FIG. 2 is a plan view of a dispenser device according to the present invention;

FIG. 2A is a diagrammatic representation of a partial plan view of the dispenser device, according to the present invention, showing the convex portion as initially formed;

Turning now to FIG. 1, one method of producing the dispensing device of the present invention will now be described in detail. The process consists of providing a roll of synthetic material 2, such as vinyl or polyvinyl chloride, on suitable rotatable support means and conveying a portion of that material through a pair of inwardly facing heaters 4 so that the synthetic material 2 is heated to a temperature (approximately 320° F.) at which it is moldable. The heated synthetic material is then conveyed over an appropriate mold 6, having a desired shape. Once positioned, the mold 6 is raised and then the forming means 8 are lowered into the mold 6 to cause the synthetic material 2 to conform to the interior shape of the mold 6. To further assist with formation, a plurality of small openings (not shown) are provided along the forming surface of the mold 6 in which air can be evacuated to pull the heated synthetic material into close conformity with the interior shape of the mold. Thereafter, appropriate cooling of the formed synthetic material is achieved by blowing cooling air through a plurality of small openings (not shown) provided along the forming surface of the forming means 8, or by other suitable cooling means. Lastly, the mold 6 and the forming means 8 are both retracted and the molded synthetic material 2 is then conveyed to a converting station, generally depicted at 10, where die cutting of the excess perimeter material from the dispensing device thereby formed is achieved in a manner well known in such molding process.

The above process is typically referred to as a thermoforming or vacuum forming process which is capable of forming a dispensing device from a single piece of synthetic material. The mold 6, the forming means 8 and the converting means 10 are typically designed so that the resulting dispensing device will not be formed with any sharp edges or corners and will have small radius sections at the transitions between adjoining walls to improve the durability of the device and minimize the possibility of fracture during use. The synthetic material used for forming the dispensing device typically has a thickness between 15 and 70/1000 of an inch. It is to be appreciated that other processes, such as injection molding and blow molding, may be used to form the dispensing device of the present invention.

Figure 3:
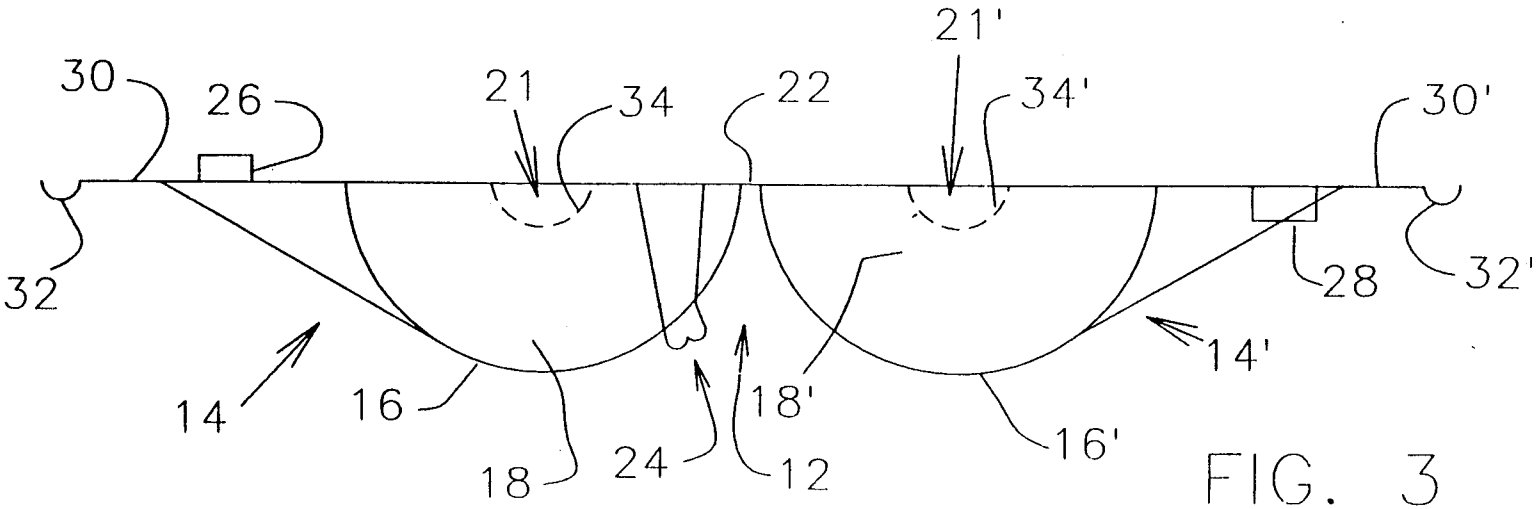
FIG. 3 is a side elevational view of the dispenser device shown in FIG. 2.

Turning now to FIGS. 2 and 3, the basic components of the dispensing device 12 will now be described in detail. It comprises a pair of open-sided members 14, 14', i.e. a member having one opened side. Each open-sided member comprises an elongate curved base portion 16, 16' having a pair of end walls 18, 18' and 20, 20', one at each end of the curved base portion 16, 16'. Each open-sided member 14, 14' defines a cavity or recess 21, 21' for accommodating substantially half of the roll of the paper product 33 (see FIG. 4) to be dispensed.

Figure 4:
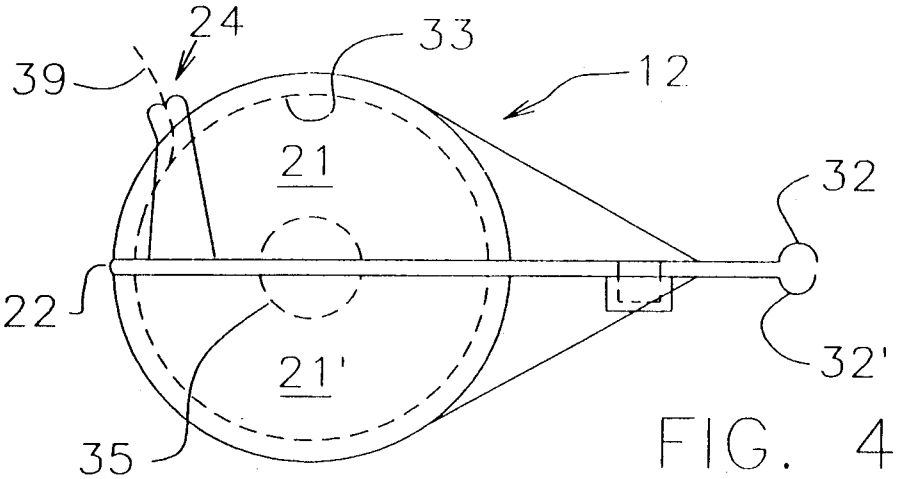
FIG. 4 is a side elevational view of the dispenser device shown in FIG. 2, depicted in its closed position, with a paper product roll, shown in dashed lines, contained therein.

The pair of open-sided members 14, 14' are connected together along a longitudinal edge of their respective curved base portions 16, 16' by a living hinge 22 or other similar hinge means, as can be seen in FIGS. 2 through 4. Alternatively, the hinge mean could be formed along an endwall. It is also anticipated that the open sided members 14, 14' could be fabricated as two pieces which could be hinged together by an interlocking arrangement carried by each of the members. One of the curved base portions 16 is provided with an elongate slot 24, which is wider than the paper product to be dispensed but does not extend the entire width of the base portion 16. A flap area (extension) 30, 30' is provided along a longitudinal edge of each of the open-sided members 14, 14' remote from the hinged edge. One of the flap areas 30 is provided with protrusion means 26, see FIG. 3, projecting outwardly from the plane in which the one flap area 30 lies while the other flap area 30' is provided with mating recess means 28 projecting inwardly from the plane in which that other flap area lies. The engagement between the protrusion means 26 and recess means 28 maintains the two open-sided members 14, 14' in their closed position which is shown in FIG. 4.

Figure 1:
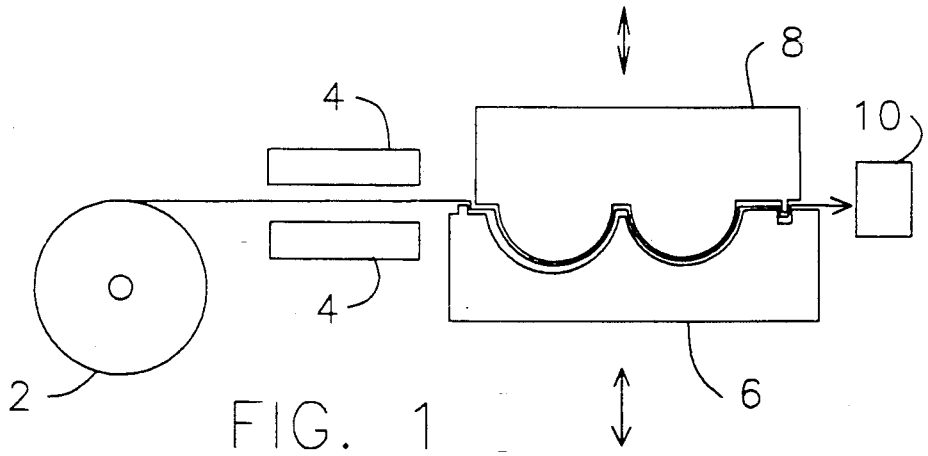
FIG. 1 is a diagrammatic representation of a forming apparatus by which a dispenser device, according to the present invention, may be formed.
Figure 5:
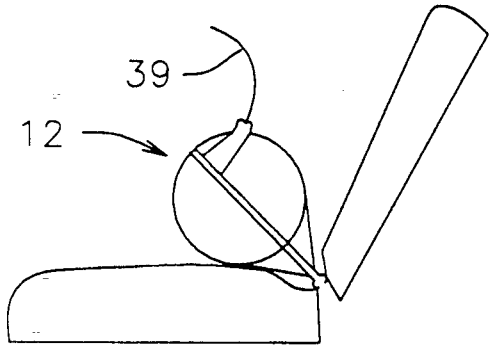
FIG. 5 is a diagrammatic representation showing one example of how the flap means of the dispenser device can be used to releasably secure the device during use.
Figure 6:
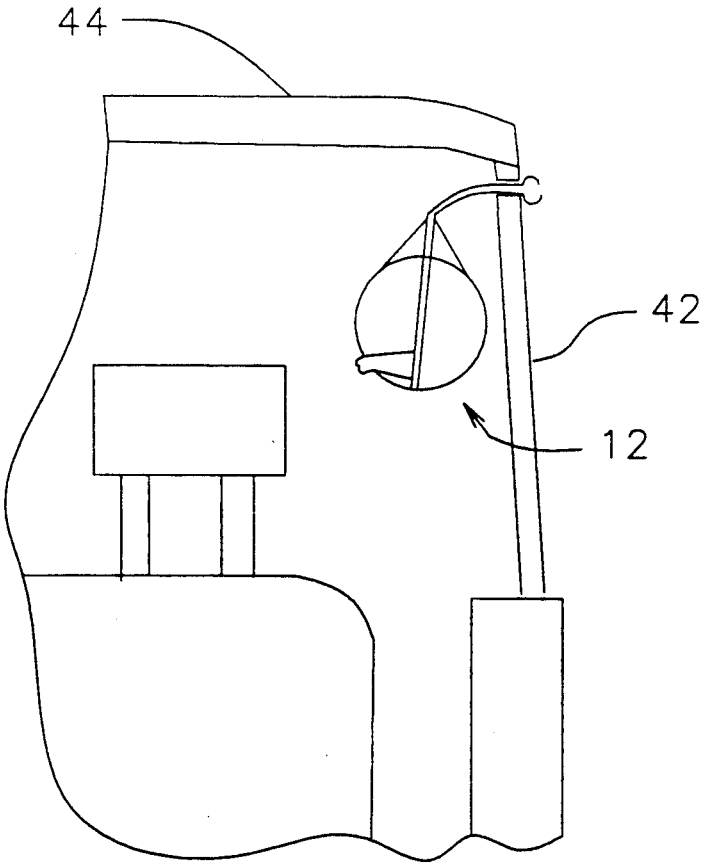
FIG. 6 is a diagrammatic representation showing use of the flap means to position the dispenser device between a car window and its associated frame.

An enlarged end portion 32, 32' is provided along a longitudinal edge of each flap area 30, 30' remote from the curved base portions 16, 16'. The enlarged end portion 32, 32' is shown as a curved elongate section, but it will be appreciated that many other types of enlarged end portions could also be employed, some of which may be resiliently deformable. The purpose of the enlarged end portions 32, 32' is to allow the flap areas 30, 30' to be retained between a pair of closely spaced but separable or deformable members, such as between the base portion and backrest portion of a car seat, as can be seen FIG. 5. Both enlarged end portions 32, 32' may be partially compressed as the flap areas 30, 30' are wedged between the closely spaced members. However, due to the rigidity and/or resilience of the enlarged end portions, they provide additional friction, once appropriately wedged between the two closely spaced members, to retain the dispensing device 12 in that location. Additionally, the flap portion can be positioned between a car window 42 and its associated car door frame 44, as can be seen in FIG. 6. In this instance, the enlarged end portions 32, 32' prevent the flat areas 30, 30' from being pulled completely through the small space between the car window and the door frame and thereby releasably retain the dispensing device 12 in the supported location to allow one-handed dispensing of the paper product.

Each of the end walls 18, 18' and 20, 20' may be provided with a partial concave portion 34", 34"', shown in FIG. 2A, which can be pressed into the cavity 21, 21', after suitable trimming, to form concave supports 34, 34', as shown with dashed lines in FIGS. 2 and 3, which, when the dispensing device 12 is in its closed position (see FIG. 4), forms a central pivot means about which the paper core 35, supporting the paper product, can pivot to improve rotation of the paper product within the dispensing device. In addition, or alternatively, the four end walls 18, 18' and 20, 20' can be formed with an inwardly facing slightly conical or spherical shape, shown in FIG. 2 as dashed lines 36, to assist with rotation of the paper product within the dispensing device.

Figure 7:
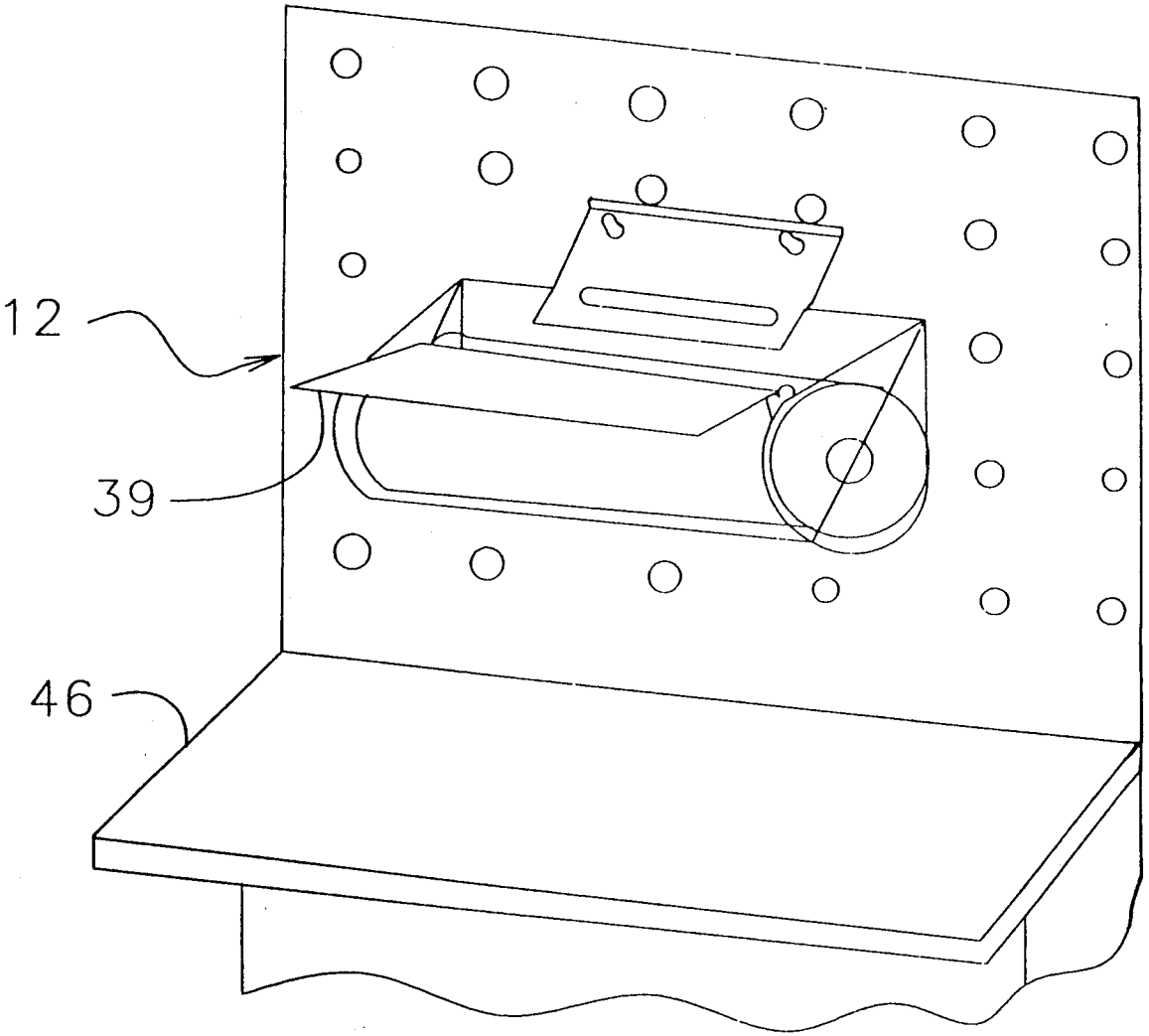
FIG. 7 is a diagrammatic representation showing use of the holes to suspend the dispenser device to a work bench.

A pair of holes 38 are provided, one on each end of the flap area 30, 30', to allow the dispensing device 12 to be hung by hooks, rope, wire or other suitable means, such as in a basement or to a workshop bench 46, to assist with dispensing of the paper product 39 when desired, as can be seen in FIG. 7.

Since certain changes may be made in the above dispensing device without departing from the spirit and scope of the invention here involved, it is intended that all matter contained in the above description and shown in the accompanying drawings shall not be construed as limiting the invention, but shall be interpreted as illustrating the inventive concept herein involved.

Wherefore, I claim:

1. A releasably attachable dispensing device, for dispensing a paper product supported on a roll, comprising:

first and second open-sided members, each having a cavity therein, being connected to one another along an edge thereof by means for allowing said first and second open-sided members to hinge relative to one another to encase completely within the cavities, when provided, a paper product supported on a roll; and at least one of said open-sided members having a longitudinal slot therein for dispensing paper product from the roll, as desired, when a said paper product supported on a roll is encased by said first and second open-sided members;

at least one of said first and second open-sided members has a flap extension connected thereto along a longitudinal edge thereof remote from said hinge means, said flat extension having an curved elongate section along a longitudinal edge thereof remote from said cavity, the curved elongate section is at least partially deformable when positioned, via said flap extension, in an opening between two closely spaced members having a width smaller than a width of the curved elongate section whereby said curved elongate section, when positioned between said two closely spaced members, frictionally engages the opening of said two closely spaced members and attaches the dispensing device, thereby facilitating dispensing of the paper product when encased therein, and said curved elongate section is readily releasable and withdrawable from said two closely spaced members, as desired.

2. A releasably attachable dispensing device according to claim 1, wherein both of said first and second open-sided members having a flap extension connected thereto at a location thereof remote from said hinge means, each of said flap extensions is provided with means for releasably retaining said dispersing device in the closed position, and said releasable retaining means comprises a protrusion element carried by one of said flap extensions and a mating recess element carried by the other of said flap extension.

3. A releasably attachable dispensing device, for dispensing a paper product supported on a roll, comprising:

first and second open-sided members, each having a cavity, being connected to one another along an edge thereof by a hinge allowing said first and second open-sided members to pivot relative to one another, said first and second open-sided members, when in an open position, allow receipt of a paper product supported on a roll within one of the cavities, and, when in a closed positioned, completely encase within the cavities a said paper product supported on a roll, when provided; and at least one of said open-sided members having a longitudinal slot therein for dispensing said paper product from the roll as desired;

said first and second open-sided members each having a flap extension connected thereto at a location remote from said hinge, said flap extensions each being provided with means for releasably retaining said dispensing device in the closed position, each of said flap extensions carrying an elongate enlarged portion adjacent a longitudinal edge thereof remote from the cavity, the elongate enlarged portions are at least partially deformable when positioned, via said flap extension, in an opening between two closely spaced members having a width smaller than a width of the elongate enlarged portions whereby said elongate enlarged portions, when positioned between said two closely spaced members, frictionally engage the opening of said two closely spaced members and attach the dispensing device, thereby facilitating dispensing of the paper product when encased therein, and the elongate enlarged portions are readily releasable and withdrawable from said two closely spaced members, as desired.

4. A releasably attachable dispensing device according to claim 3, wherein the cavity of said first and second open-sided members is defined by an elongate curved base portion having a pair of opposed end walls.

5. A releasably attachable dispensing device according to claim 4, wherein the cavities are semi-cylindrical cavities whereby when said first and second open-sided members are moved into the closed position, the two semi-cylindrical cavities form a cylindrical cavity for accommodating a said roll of paper product.

6. A releasably attachable dispensing device according to claim 3, wherein said releasable retaining means comprises a protrusion element carried by one said flap extension and a recess element carried by the other said flap extension.

7. A releasably attachable dispensing device according to claim 3, wherein said dispensing device is manufactured from a synthetic material.

8. A releasably attachable dispensing device according to claim 7, wherein said synthetic material is one of vinyl and polyvinyl chloride.

9. A releasably attachable dispensing device according to claim 7, wherein said synthetic material has a thickness between about 15 and 70 thousandths of an inch.

10. A releasably attachable dispensing device according to claim 3, wherein each of said enlarged portions comprises a curved elongate section extending along an edge of said flap extension remote from said cavity.

11. A releasably attachable dispensing device according to claim 3, wherein each end wall carries a pivot about which the roll or paper product, when provide, can rotate to assist with dispensing of the paper product.

12. A releasably attachable dispensing device according to claim 11, wherein said pivot comprises a partial concave portion formed in the two opposed end walls of each of said first and second open-sided members.

13. A releasably attachable dispensing device according to claim 11, wherein said pivot comprises a partial convex portion formed in the two opposed end walls of each of said first and second open-sided members, each partial convex portion is deformed inwardly, prior to use, to form said pivot.

14. A releasably attachable dispensing device according to claim 3, wherein at least a portion of each end wall of said first and second open-sided members has a slight spherical shape which, when the dispensing device is in the close position, forms said pivot.

15. A releasably attachable dispensing device according to claim 3, wherein said dispensing device is provided with smooth transitions between adjoining walls and surfaces to improve the durability of the device.

* * * * *